US007327634B2

(12) United States Patent
Perry et al.

(10) Patent No.: US 7,327,634 B2
(45) Date of Patent: Feb. 5, 2008

(54) ROTARY PULSER FOR TRANSMITTING INFORMATION TO THE SURFACE FROM A DRILL STRING DOWN HOLE IN A WELL

(75) Inventors: Carl A. Perry, Middletown, CT (US); Daniel E. Burgess, Middletown, CT (US); William E. Turner, St. Louis, MO (US)

(73) Assignee: APS Technology, Inc., Wallingford, CT (US)

( * ) Notice: Subject to any disclaimer, the term of this patent is extended or adjusted under 35 U.S.C. 154(b) by 281 days.

(21) Appl. No.: 10/888,312

(22) Filed: Jul. 9, 2004

(65) Prior Publication Data

US 2006/0034154 A1 Feb. 16, 2006

(51) Int. Cl.
*H04H 9/00* (2006.01)

(52) U.S. Cl. ..... 367/84; 367/83; 367/85; 340/853.1; 340/854.3; 340/854.4; 340/855.4; 340/856.4

(58) Field of Classification Search ..... 367/84, 367/83, 85; 340/854.3, 854.4, 855.4, 856.4, 340/853.1; 175/48
See application file for complete search history.

(56) References Cited

U.S. PATENT DOCUMENTS

| | | | |
|---|---|---|---|
| 2,901,685 A | 10/1959 | Alder | 323/74 |
| 2,964,116 A | 12/1960 | Peterson | 175/48 |
| 2,973,505 A | 2/1961 | Johannesen | 340/18 |
| 3,065,416 A | 11/1962 | Jeter | 324/70 |
| 3,302,457 A | 2/1967 | Mayes | 73/152 |

(Continued)

FOREIGN PATENT DOCUMENTS

EP 0 140 788 A2 5/1985

(Continued)

OTHER PUBLICATIONS

Chin, W.C. Ph.D., "NWD Siren Pulser Fluid Mechanics", *StrataMegnetic Software, LLC*, Houston Texas, Aug. 4, 2003, 1-23.

*Primary Examiner*—Jeffery Hofsass
*Assistant Examiner*—Sisay Yacob
(74) *Attorney, Agent, or Firm*—Woodcock Washburn LLP

(57) ABSTRACT

A rotary pulser for transmitting information to the surface from down hole in a well by generating pressure pulses encoded to contain information. The pressure pulses travel to the surface where they are decoded so as to decipher the information. The pulser includes housing containing a stator forming passages through which drilling fluid flows on its way to the drill bit, a rotor, and a replaceable wear sleeve enclosing the rotor. The rotor has blades that are capable of imparting a varying obstruction to the flow of drilling fluid through the stator passages depending on the circumferential orientation of the rotor, so that rotation of the rotor by a motor generates the encoded pressure pulses. The rotor is located downstream of the stator and the rotor blades are shaped so that when the motor is not in operation, a hydrodynamic opening torque is imparted to the rotor that tends to rotate the rotor blades away from the circumferential orientation that results in the maximum obstruction and toward the circumferential orientation that results in the minimum obstruction. A torsion spring provides a mechanical force that also tends to rotate the rotor into the orientation that provides the minimum flow obstruction.

48 Claims, 13 Drawing Sheets

U.S. PATENT DOCUMENTS

| | | | | |
|---|---|---|---|---|
| 3,309,656 | A | 3/1967 | Godbey | 340/18 |
| 3,693,428 | A | 9/1972 | LePeuvedic et al. | 73/151 |
| 3,713,089 | A | 1/1973 | Clacomb | 340/18 LD |
| 3,732,728 | A | 5/1973 | Fitzpatrick | 73/151 |
| 3,736,558 | A | 5/1973 | Cubberly, Jr. | 340/18 |
| 3,737,843 | A | 6/1973 | LePeuvedic et al. | 340/18 NC |
| 3,739,331 | A | 6/1973 | Godbey et al. | 340/18 LD |
| 3,742,443 | A | 6/1973 | Foster et al. | 340/18 LD |
| 3,764,968 | A | 10/1973 | Anderson | 340/18 NC |
| 3,764,969 | A | 10/1973 | Cubberly, Jr. | 340/15 NC |
| 3,764,970 | A | 10/1973 | Manning | 340/18 NC |
| 3,770,006 | A | 11/1973 | Sexton et al. | 137/499 |
| 3,958,217 | A | 5/1976 | Spinnler | 340/18 LD |
| 3,964,556 | A | 6/1976 | Gearhart et al. | 175/45 |
| 4,007,805 | A | 2/1977 | Reber | 181/120 |
| RE29,734 | E | 8/1978 | Manning | 340/18 NC |
| RE30,055 | E | 7/1979 | Claycomb | 340/18 LD |
| 4,351,037 | A | 9/1982 | Scherbatskoy | 367/85 |
| 4,462,469 | A | 7/1984 | Brown | 175/40 |
| 4,499,563 | A | 2/1985 | Jurgens | 367/84 |
| 4,628,495 | A | 12/1986 | Peppers et al. | 367/85 |
| 4,630,244 | A | 12/1986 | Larronde | 367/84 |
| RE32,463 | E | 7/1987 | Westlake et al. | 175/48 |
| 4,698,794 | A | 10/1987 | Kruger et al. | 367/83 |
| 4,734,892 | A | 3/1988 | Kotlyar | 367/83 |
| 4,785,300 | A | 11/1988 | Chin et al. | 340/861 |
| 4,790,393 | A | 12/1988 | Larronde et al. | 175/40 |
| 4,796,699 | A | 1/1989 | Upchurch | 166/250 |
| 4,847,815 | A | 7/1989 | Malone | 367/84 |
| 4,914,637 | A | 4/1990 | Goodsman | 367/83 |
| 4,915,168 | A | 4/1990 | Upchurch | 166/250 |
| 4,956,823 | A | 9/1990 | Russell et al. | 367/84 |
| 5,073,877 | A | 12/1991 | Jeter | 367/84 |
| 5,079,750 | A | 1/1992 | Scherbatskoy | 367/85 |
| 5,113,379 | A | 5/1992 | Scherbatskoy | 367/83 |
| 5,119,344 | A | 6/1992 | Innes | 367/84 |
| 5,182,731 | A | 1/1993 | Hoelscher et al. | 367/84 |
| 5,189,645 | A | 2/1993 | Innes | 367/84 |
| 5,215,152 | A | 6/1993 | Duckworth | 175/48 |
| 5,357,483 | A | 10/1994 | Innes | 367/84 |
| 5,517,464 | A | 5/1996 | Lerner et al. | 367/84 |
| 5,586,084 | A | 12/1996 | Barron et al. | 367/85 |
| 5,636,178 | A * | 6/1997 | Ritter | 367/84 |
| 5,691,712 | A | 11/1997 | Meek et al. | 340/853.3 |
| 5,787,052 | A | 7/1998 | Gardner et al. | 367/84 |
| 6,105,690 | A | 8/2000 | Biglin, Jr. et al. | 175/48 |
| 6,219,301 | B1 * | 4/2001 | Moriarty | 175/48 |
| 6,289,998 | B1 | 9/2001 | Krueger et al. | 175/25 |
| 6,469,637 | B1 | 10/2002 | Seyler et al. | 340/856.3 |
| 6,714,138 | B1 | 3/2004 | Turner et al. | 340/854.3 |

FOREIGN PATENT DOCUMENTS

| | | |
|---|---|---|
| EP | 0 140 788 A3 | 5/1985 |
| EP | 0 325 047 A2 | 7/1989 |
| EP | 0 325 047 A3 | 7/1989 |
| GB | 2 156 405 A | 10/1985 |
| WO | WO 02/29441 A1 | 4/2002 |

* cited by examiner

ROTARY PULSER FOR TRANSMITTING INFORMATION TO THE SURFACE FROM A DRILL STRING DOWN HOLE IN A WELL

FIELD OF THE INVENTION

The current invention is directed to an improved rotary pulser for transmitting information from a down hole location in a well to the surface, such as that used in a mud pulse telemetry system employed in a drill string for drilling an oil well.

BACKGROUND OF THE INVENTION

In underground drilling, such as gas, oil or geothermal drilling, a bore is drilled through a formation deep in the earth. Such bores are formed by connecting a drill bit to sections of long pipe, referred to as a "drill pipe," so as to form an assembly commonly referred to as a "drill string" that extends from the surface to the bottom of the bore. The drill bit is rotated so that it advances into the earth, thereby forming the bore. In rotary drilling, the drill bit is rotated by rotating the drill string at the surface. In directional drilling, the drill bit is rotated by a down hole mud motor coupled to the drill bit; the remainder of the drill string is not rotated during drilling. In a steerable drill string, the mud motor is bent at a slight angle to the centerline of the drill bit so as to create a side force that directs the path of the drill bit away from a straight line. In any event, in order to lubricate the drill bit and flush cuttings from its path, piston operated pumps on the surface pump a high pressure fluid, referred to as "drilling mud," through an internal passage in the drill string and out through the drill bit. The drilling mud then flows to the surface through the annular passage formed between the drill string and the surface of the bore.

Depending on the drilling operation, the pressure of the drilling mud flowing through the drill string will typically be between 1,000 and 25,000 psi. In addition, there is a large pressure drop at the drill bit so that the pressure of the drilling mud flowing outside the drill string is considerably less than that flowing inside the drill string. Thus, the components within the drill string are subject to large pressure forces. In addition, the components of the drill string are also subjected to wear and abrasion from drilling mud, as well as the vibration of the drill string.

The distal end of a drill string, which includes the drill bit, is referred to as the "bottom hole assembly." In "measurement while drilling" (MWD) applications, sensing modules in the bottom hole assembly provide information concerning the direction of the drilling. This information can be used, for example, to control the direction in which the drill bit advances in a steerable drill string. Such sensors may include a magnetometer to sense azimuth and accelerometers to sense inclination and tool face.

Historically, information concerning the conditions in the well, such as information about the formation being drill through, was obtained by stopping drilling, removing the drill string, and lowering sensors into the bore using a wire line cable, which were then retrieved after the measurements had been taken. This approach was known as wire line logging. More recently, sensing modules have been incorporated into the bottom hole assembly to provide the drill operator with essentially real time information concerning one or more aspects of the drilling operation as the drilling progresses. In "logging while drilling" (LWD) applications, the drilling aspects about which information is supplied comprise characteristics of the formation being drilled through. For example, resistivity sensors may be used to transmit, and then receive, high frequency wavelength signals (e.g., electromagnetic waves) that travel through the formation surrounding the sensor. By comparing the transmitted and received signals, information can be determined concerning the nature of the formation through which the signal traveled, such as whether it contains water or hydrocarbons. Other sensors are used in conjunction with magnetic resonance imaging (MRI). Still other sensors include gamma scintillators, which are used to determine the natural radioactivity of the formation, and nuclear detectors, which are used to determine the porosity and density of the formation.

In traditional LWD and MWD systems, electrical power was supplied by a turbine driven by the mud flow. More recently, battery modules have been developed that are incorporated into the bottom hole assembly to provide electrical power.

In both LWD and MWD systems, the information collected by the sensors must be transmitted to the surface, where it can be analyzed. Such data transmission is typically accomplished using a technique referred to as "mud pulse telemetry." In a mud pulse telemetry system, signals from the sensor modules are typically received and processed in a microprocessor-based data encoder of the bottom hole assembly, which digitally encodes the sensor data. A controller in the control module then actuates a pulser, also incorporated into the bottom hole assembly, that generates pressure pulses within the flow of drilling mud that contain the encoded information. The pressure pulses are defined by a variety of characteristics, including amplitude (the difference between the maximum and minimum values of the pressure), duration (the time interval during which the pressure is increased), shape, and frequency (the number of pulses per unit time). Various encoding systems have been developed using one or more pressure pulse characteristics to represent binary data (i.e., bit 1 or 0)—for example, a pressure pulse of 0.5 second duration represents binary 1, while a pressure pulse of 1.0 second duration represents binary 0. The pressure pulses travel up the column of drilling mud flowing down to the drill bit, where they are sensed by a strain gage based pressure transducer. The data from the pressure transducers are then decoded and analyzed by the drill rig operating personnel.

Various techniques have been attempted for generating the pressure pulses in the drilling mud. One technique involves incorporating a pulser into the drill string in which the drilling mud flows through passages formed by a stator. A rotor, which is typically disposed upstream of the stator, is either rotated continuously, referred to as a mud siren, or is incremented, either by oscillating the rotor or rotating it incrementally in one direction, so that the rotor blades alternately increase and decrease the amount by which they obstruct the stator passages, thereby generating pulses in the drilling fluid. An oscillating type pulser valve is disclosed in U.S. Pat. No. 6,714,138 (Turner et al.), hereby incorporated by reference in its entirety. A prior art rotor used in a commercial embodiment of U.S. Pat. No. 6,714,138 (Turner et al.) is shown in FIG. 1. In that embodiment, the rotor was located upstream of the stator, as shown in U.S. Pat. No. 6,714,138 (Turner et al.), and was oriented with respect to the direction of the flow of drilling mud so that the downstream surface of the blade was a flat surface, with the upstream surface of the blade tapering so that the thickness at the radial tip of the blade was about ⅛ inch (3 mm).

Unfortunately, in such prior pulsers, the flow of drilling mud creates pressure forces that tend to drive the rotor into a position in which the rotor blades provide the maximum obstruction to the flow of drilling mud. Consequently, if the motor driving the pulser fails, the flow induced torque will cause the rotor to remain stationary in the position of maximum obstruction, thereby interfering with flow of drilling mud, increasing the pressure of the drilling mud, and accelerating wear of the pulser components due to the high flow velocity through the obstructed passages.

Moreover, even if the motor does not fail, during periods when the pulser is not operating, the flow induced torque will gradually overcome the rotor's resistance to rotation and obstruct the mud flow. Since this unnecessary obstruction to the flow of drilling mud is undesirable, the rotor position must be monitored and the pulser motor periodically employed to rotate the rotor into the position of minimum obstruction. This results in an unnecessary drain on the battery that powers the motor.

According to one approach, described in U.S. Pat. No. 4,785,300 (Chin et al), the generation of a flow induced torque tending to rotate the rotor into the obstruction orientation may be prevented in certain pulsers by shaping rotor blades, located downstream of the stator, so that their sides are outwardly tapered, and thus become wider in the circumferential direction, as they extend in the downstream direction. However, this approach is not believed to be entirely satisfactory in many situations.

Consequently, it would be desirable to provide a mud pulse telemetry system in which the rotor blades were prevented from unintentionally rotating into the obstructed position when the pulser was not being utilized to transmit information, without the need to operate the pulser motor.

In addition, the portions of a pulser subject to the high velocity flow of drilling mud are subject to wear. Consequently, it would also be desirable to develop a pulser with increased resistance to wear in such high flow areas.

SUMMARY OF THE INVENTION

It is an object of the current invention to provide an improved apparatus for transmitting information from a portion of a drill string operating at a down hole location in a well bore to a location proximate the surface of the earth, the drill string having a passage through which a drilling fluid flows, comprising a rotary pulser having (i) a housing adapted to be mounted in the drill string, (ii) a stator supported in the housing and having at least one approximately axially extending passage formed therein through which at least a portion of the drilling fluid flows, (iii) a rotor supported in the housing adjacent the stator and downstream therefrom, the rotor having at least one blade extending radially outward so as to define a radial height thereof, the blade imparting a varying degree of obstruction to the flow of drilling fluid flowing through the stator passage depending on the circumferential orientation of the rotor, the rotor being rotatable into at least first and second circumferential orientations, the first rotor circumferential orientation providing a greater obstruction to the flow of drilling fluid than that of the second rotor circumferential orientation, whereby rotation of the rotor generates a series of pulses encoded with the information to be transmitted, (iv) a motor coupled to the rotor for imparting rotation to the rotor, whereby operation of the motor generates the series of encoded pulses, and (v) means for imparting a torque to reduce the obstruction imparted by the blade to the flow of drilling fluid when the motor is not operating to transmit the information by urging the rotor to rotate away from the first circumferential orientation and toward the second circumferential orientation. In one embodiment of the invention, a replaceable wear sleeve is disposed in the housing enclosing the rotor.

DETAILED DESCRIPTION OF ILLUSTRATIVE EMBODIMENTS

Figure 2:
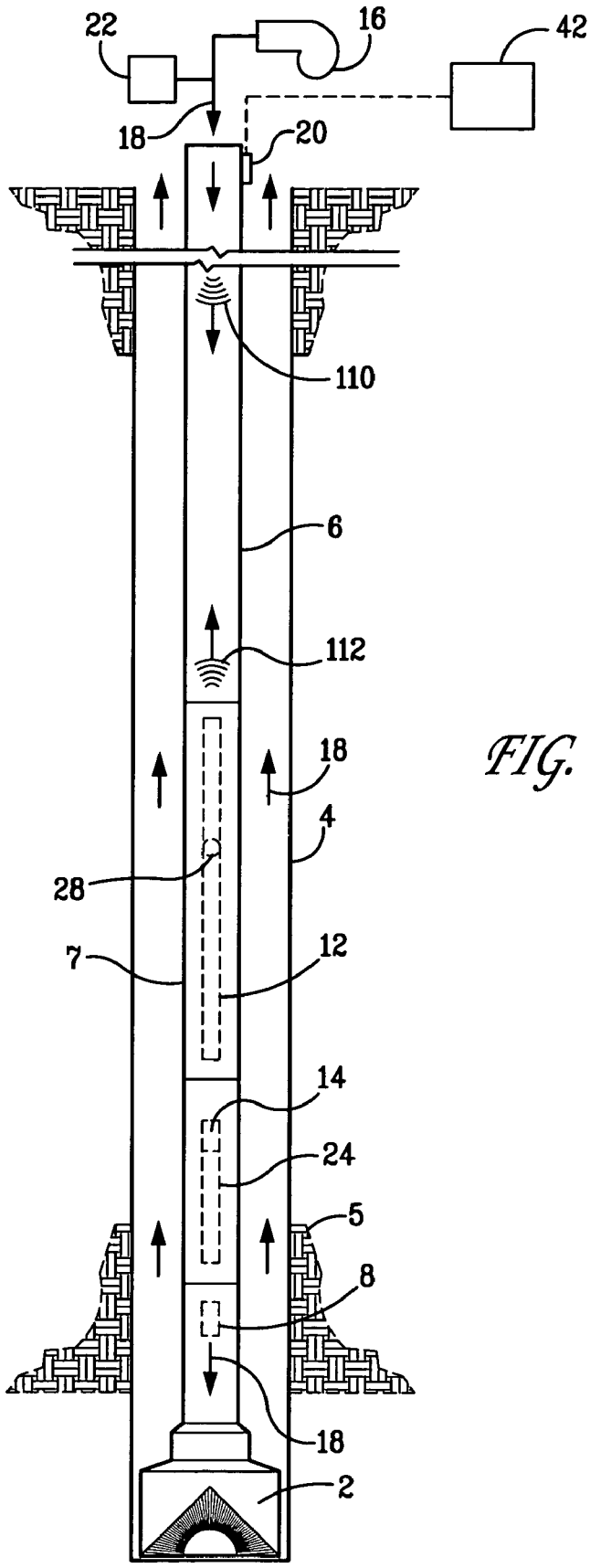
FIG. 2 is a diagram, partially schematic, showing a drilling operation employing the mud pulse telemetry system of the current invention.

A drilling operation incorporating a mud pulse telemetry system according to the current invention is shown in FIG. 2. A drill bit 2 drills a bore hole 4 into a formation 5. The drill bit 2 is attached to a drill string 6 that, as is conventional, is formed of sections of piping joined together. As is also conventional, a mud pump 16 pumps drilling mud 18 downward through the drill string 6 and into the drill bit 2. The drilling mud 18 flows upward to the surface through the annular passage between the bore 4 and the drill string 6, where, after cleaning, it is recirculated back down the drill string by the mud pump 16. As is conventional in MWD and LWD systems, sensors 8, such as those of the types discussed above, are located in the bottom hole assembly portion 7 of the drill string 6. In addition, a surface pressure sensor 20, which may be a transducer, senses pressure pulses in the drilling mud 18. According to a preferred embodiment of the invention, a pulser device 22, such as a valve, is located at the surface and is capable of generating pressure pulses in the drilling mud.

Figure 3:
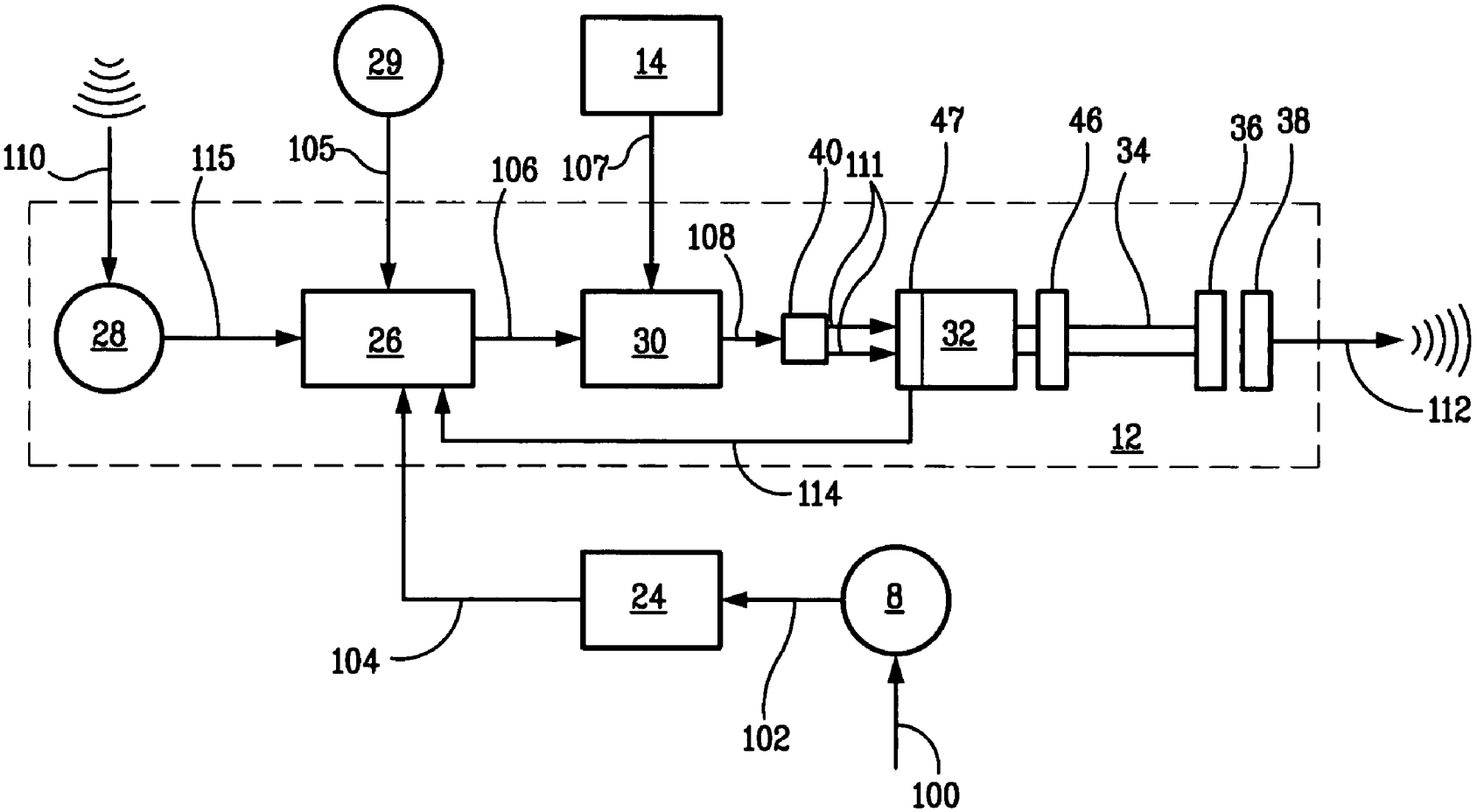
FIG. 3 is a schematic diagram of a mud pulser telemetry system according to the current invention.

As shown in FIGS. 2 and 3, in addition to the sensors 8, the components of the mud pulse telemetry system according to the current invention include a conventional mud telemetry data encoder 24, a power supply 14, which may be a battery or turbine alternator, and a down hole pulser 12 according to the current invention. The pulser comprises a controller 26, which may be a microprocessor, a motor driver 30, which includes a switching device 40, a reversible motor 32, a reduction gear 46, a rotor 36 and stator 38. The motor driver 30, which may be a current limited power stage comprised of transistors (FET's and bipolar), preferably receives power from the power supply 14 and directs it to the motor 32 using pulse width modulation. Preferably, the motor is a brushed DC motor with an operating speed of at least about 600 RPM and, preferably, about 6000 RPM. The motor 32 drives the reduction gear 46, which is coupled to the rotor shaft 34. Although only one reduction gear 46 is shown, it should be understood that two or more reduction gears could also be utilized. Preferably, the reduction gear 46 achieves a speed reduction of at least about 144:1. The sensors 8 receive information 100 useful in connection with the drilling operation and provide output signals 102 to the data encoder 24. Using techniques well known in the art, the data encoder 24 transforms the output from the sensors 8 into a digital code 104 that it transmits to the controller 26. Based on the digital code 104, the controller 26 directs control signals 106 to the motor driver 30. The motor driver 30 receives power 107 from the power source 14 and directs power 108 to a switching device 40. The switching device 40 transmits power 111 to the appropriate windings of the motor 32 so as to effect rotation of the rotor 36 in either a first (e.g., clockwise) or opposite (e.g., counterclockwise) direction so as to generate pressure pulses 112 that are transmitted through the drilling mud 18. The pressure pulses 112 are sensed by the sensor 20 at the surface and the information is decoded and directed to a data acquisition system 42 for further processing, as is conventional.

As shown in FIG. 3, preferably, both a down hole static pressure sensor 29 and a down hole dynamic pressure sensor 28 are incorporated into the drill string to measure the pressure of the drilling mud in the vicinity of the pulser 12, as described in the previously referenced U.S. Pat. No. 6,714,138 (Turner et al.). The pressure pulsations sensed by the dynamic pressure sensor 28 may be the pressure pulses generated by the down hole pulser 12 or the pressure pulses generated by the surface pulser 22. In either case, the down hole dynamic pressure sensor 28 transmits a signal 115 to the controller 26 containing the pressure pulse information, which may be used by the controller in generating the motor control signals 106. The down hole pulser 12 may also include an orientation encoder 47 suitable for high temperature applications, coupled to the motor 32. The orientation encoder 47 directs a signal 114 to the controller 26 containing information concerning the angular orientation of the rotor 36. Information from the orientation encoder 47 can be used to monitor the position of the rotor 36 during periods when the pulser 12 is not in operation and may also be used by the controller during operation in generating the motor control signals 106. Preferably, the orientation encoder 47 is of the type employing a magnet coupled to the motor shaft that rotates within a stationary housing in which Hall effect sensors are mounted that detect rotation of the magnetic poles.

Figure 4:
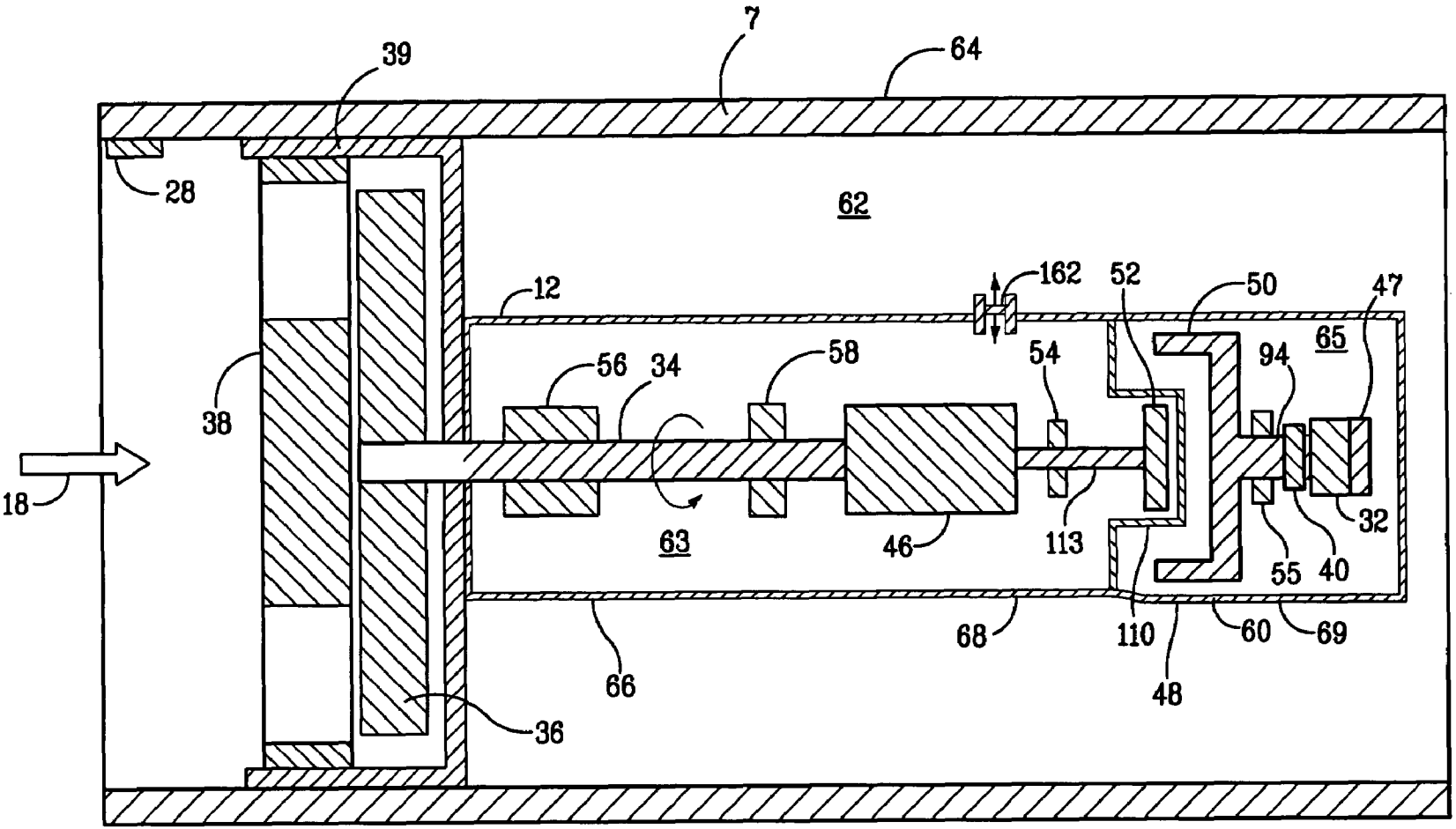
FIG. 4 is a diagram, partially schematic, of the mechanical arrangement of a pulser according to the current invention.
Figure 5:
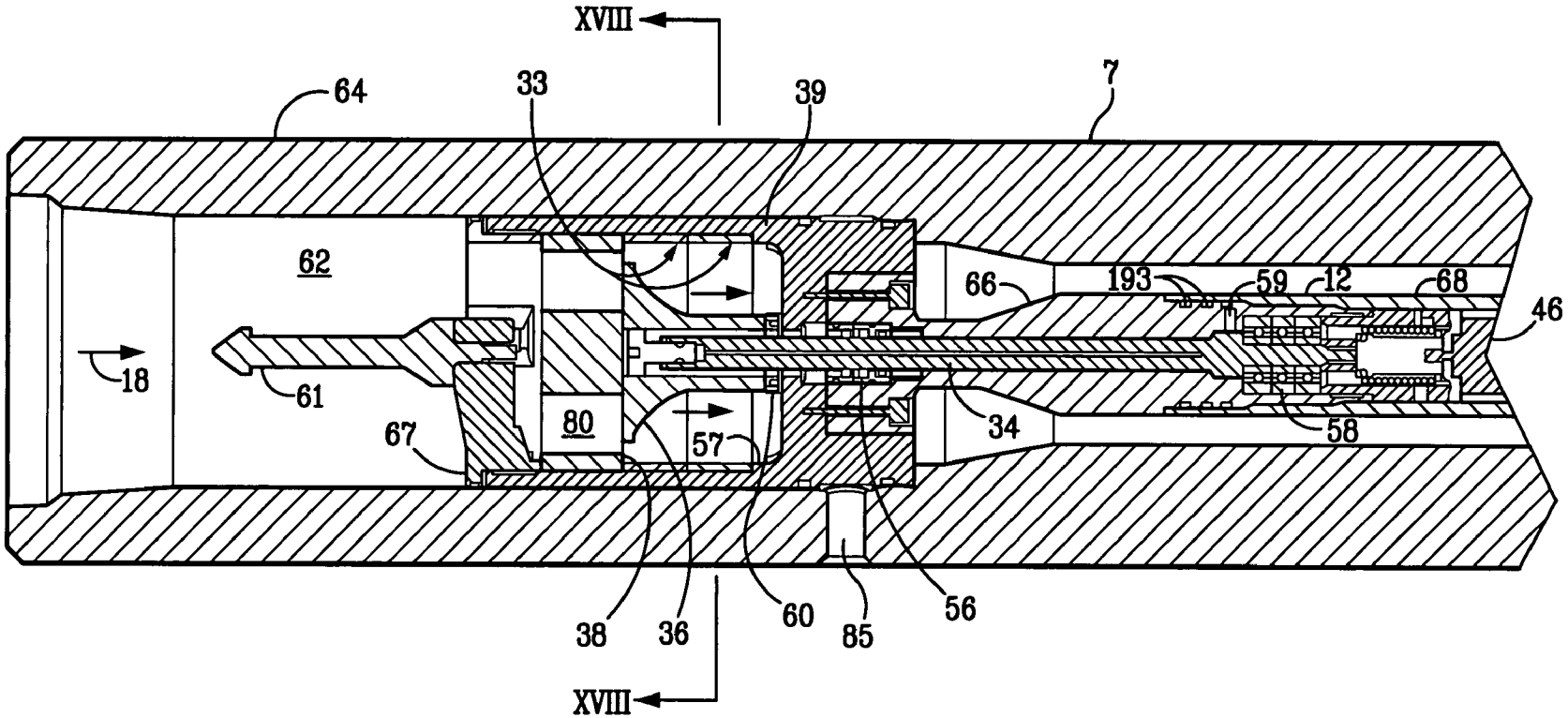
FIGS. 5-7 are consecutive portions of a longitudinal cross-section through a portion of the bottom hole assembly of the drill string shown in FIG. 2 incorporating the pulser shown in FIG. 3.
Figure 6:
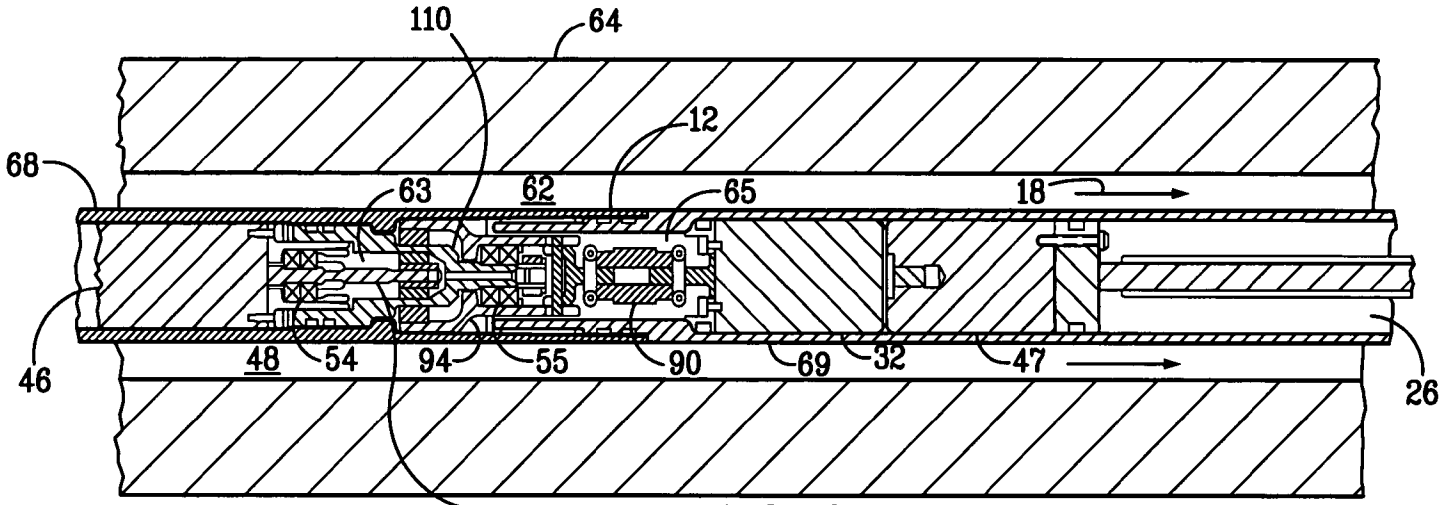
Figure 7:
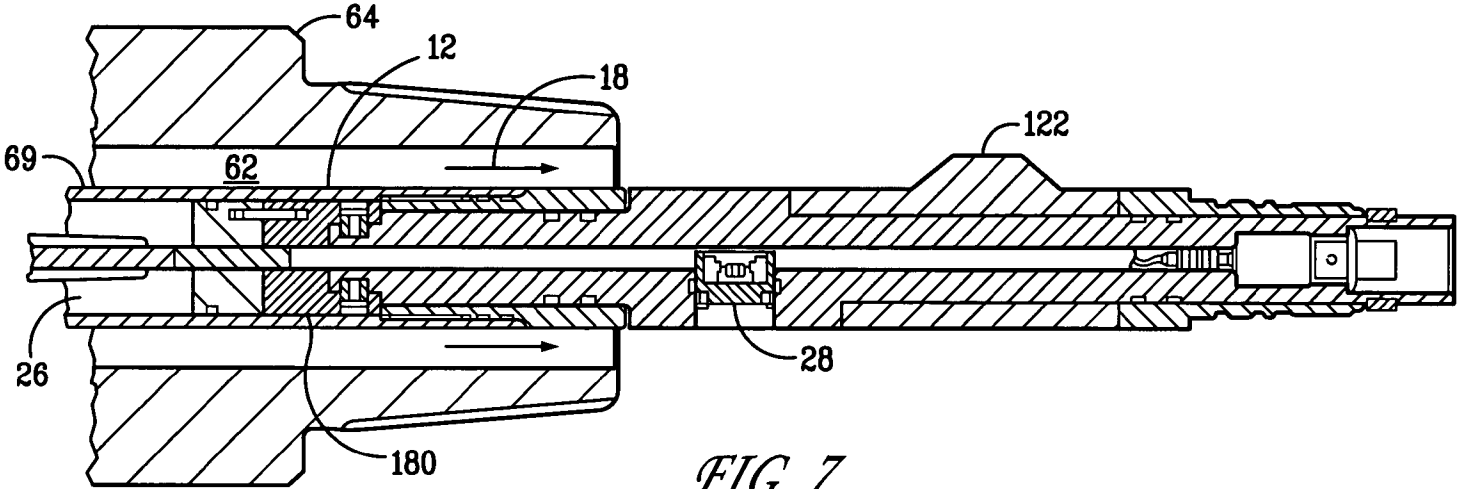

A preferred mechanical arrangement of the down hole pulser 12 is shown schematically in FIG. 4 and in more detail in FIGS. 5-7. FIG. 5 shows the upstream portion of the pulser, FIG. 6 shows the middle portion of the pulser, and FIG. 7 shows the downstream portion of the pulser. The construction of the middle and downstream portions of the pulser is described in the previously referenced U.S. Pat. No. 6,714,138 (Turner et al.).

As previously discussed, the outer housing of the drill string 6 is formed by a section of drill pipe 64, which forms the central passage 62 through which the drilling mud 18 flows. As is conventional, the drill pipe 64 has threaded couplings on each end, shown in FIGS. 5 and 7, that allow it to be mated with other sections of drill pipe. The housing for the pulser 12 is comprised of an annular shroud 39, and housing portions 66, 68, and 69, and is mounted within the passage 62 of the drill pipe section 64. As shown in FIG. 5, the upstream end of the pulser 12 is mounted in the passage 62 by the annular shroud 39. As shown in FIG. 7, the downstream end of the pulser 12 is attached via coupling 180 to a centralizer 122 that further supports it within the passage 62.

Figure 8:
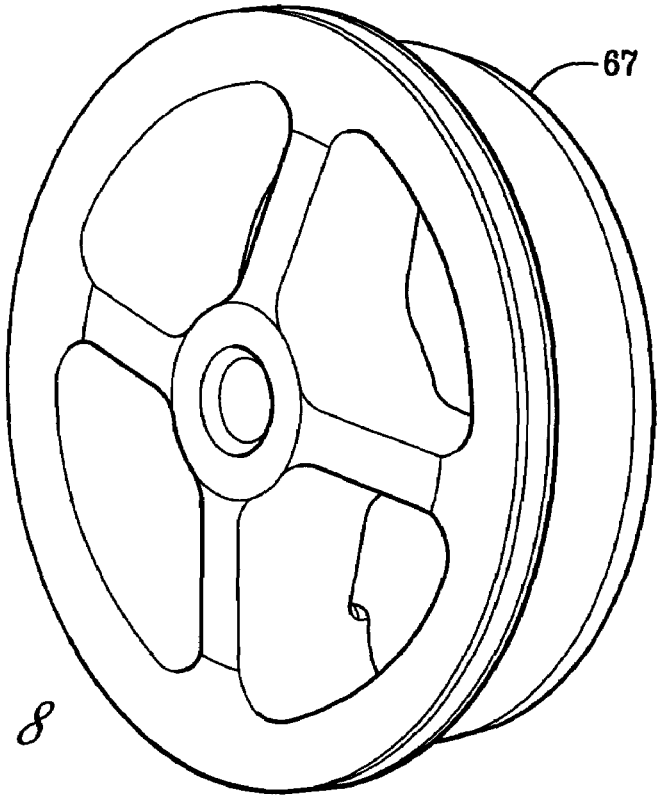
FIG. 8 is a perspective view of a strator retainer of the pulser shown in FIG. 3.
Figure 9:
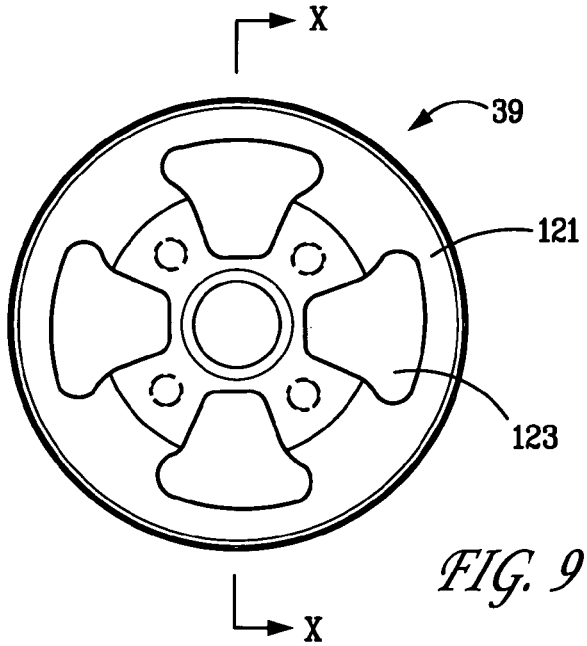
FIG. 9 is an end view of the annular shroud shown in FIG. 5.
Figure 10:
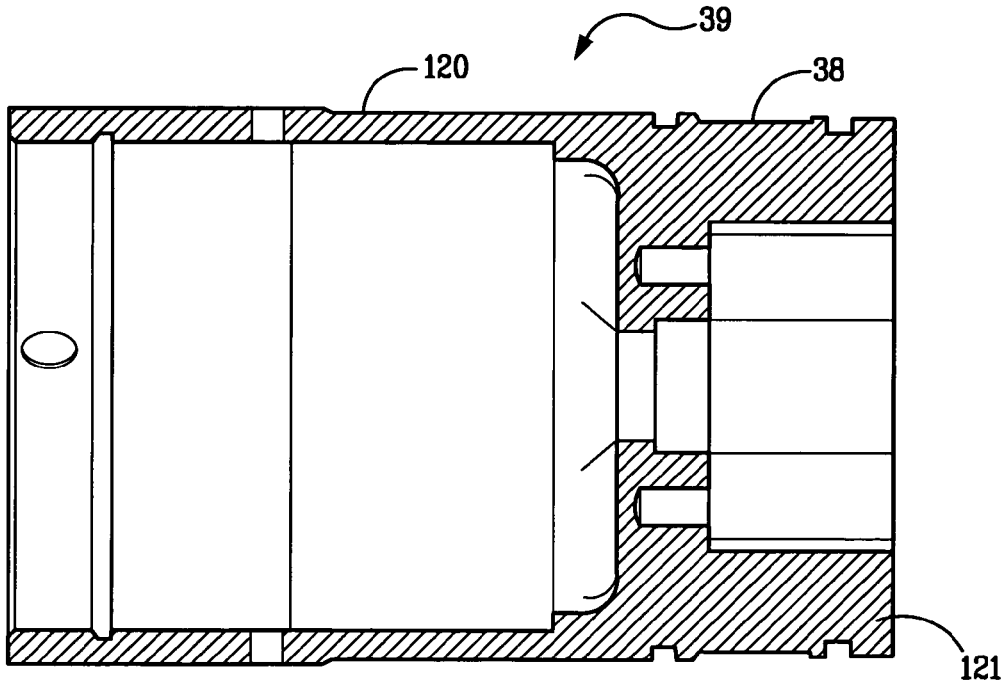
FIG. 10 is a cross-section of the annular shroud shown in FIG. 5 taken through line X-X shown in FIG. 9.

The annular shroud 39, shown in FIGS. 9 and 10, comprises a sleeve portion 120 forming a shroud for the rotor 36 and stator 38, as discussed below, and an end plate 121. As shown in FIG. 5, tungsten carbide wear sleeves 33 enclose the rotor 36 and protect the inner surface of the shroud 39 from wear as a result of contact with the drilling mud. Passages 123 are formed in the end plate 121 that allow drilling mud 18 to flow through the shroud 39. The shroud is fixed within the drill pipe 64 by a set screw (not shown) that is inserted into a hole 85 in the drill pipe. As shown in FIG. 5, a nose 61 forms the forward most portion of the pulser 12. The nose 61 is attached to a stator retainer 67, shown in FIG. 8.

The rotor 36 and stator 38 are mounted within the shroud 39. According to one aspect of the invention, the rotor 36 is located downstream of the stator 38. The stator retainer 67 is threaded into the upstream end of the annular shroud 39 and restrains the stator 38 and the wear sleeves 33 from axial motion by compressing them against a shoulder 57 formed in the shroud 39. Thus, the wear sleeves 33 can be replaced as necessary. Moreover, since the stator 38 and wear sleeves 33 are not highly loaded, they can be made of a brittle, wear resistant material, such as tungsten carbide, while the shroud 39, which is more heavily loaded but not as subject to wear from the drilling fluid, can be made of a more ductile material, such as 17-4 stainless steel.

The rotor 36 is driven by a drive train mounted in the pulser housing and includes a rotor shaft 34 mounted on upstream and downstream bearings 56 and 58 in a chamber 63. The chamber 63 is formed by upstream and downstream housing portions 66 and 68 together with a seal 60 and a barrier member 110 (as used herein, the terms upstream and downstream refer to the flow of drilling mud toward the drill bit). The seal 60 is a spring loaded lip seal. The chamber 63 is filled with a liquid, preferably a lubricating oil, that is pressurized to an internal pressure that is close to that of the external pressure of the drilling mud 18 by a piston 162 mounted in the upstream oil-filed housing portion 66. The upstream and downstream housing portions 66 and 68 that form the oil filled chamber 63 are threaded together, with the joint being sealed by O-rings 193.

As previously discussed, the rotor 36 is preferably located immediately downstream of the stator 38. The upstream face 72 of the rotor 36 is spaced from the downstream face 71 of the stator 38 by shims, not shown. Since, as discussed below, the upstream surface 72 of the rotor 36 is substantially flat, the axial gap between the stator outlet face 71 and the rotor upstream surface is substantially constant over the radial height of a blade 74. Preferably the axial gap between the upstream rotor face 72 and the downstream stator face 71 is approximately 0.030-0.060 inch (0.75-1.5 mm). The rotor 36 includes a rotor shaft 34, which is mounted within the oil-filled chamber 63 by the upstream and downstream bearings 58 and 56. The downstream end of the rotor shaft 34 is attached by a coupling 182 to the output shaft of the reduction gear 46, which may be a planetary type gear train, such as that available from Micromo, of Clearwater, Fla., and which is also mounted in the downstream oil-filled housing portion 68. The input shaft 113 to the reduction gear 46 is supported by a bearing 54 and is coupled to inner half 52 of a magnetic coupling 48, such as that available through Ugimag, of Valparaiso, Ind.

In operation, the motor 32 rotates a shaft 94 which, via the magnetic coupling 48, transmits torque through a housing barrier 110 that drives the reduction gear input shaft 113. The reduction gear drives the rotor shaft 34, thereby rotating the rotor 36. The outer half 50 of the magnetic coupling 48 is mounted within housing portion 69, which forms a chamber 65 that is filled with a gas, preferably air, the chambers 63 and 65 being separated by the barrier 110. The outer magnetic coupling half 50 is coupled to a shaft 94 which is supported on bearings 55. A flexible coupling 90 couples the shaft 94 to the electric motor 32, which rotates the drive train. The orientation encoder 47 is coupled to the motor 32. The down hole dynamic pressure sensor 28 is mounted on the drill pipe 64.

Figure 11:
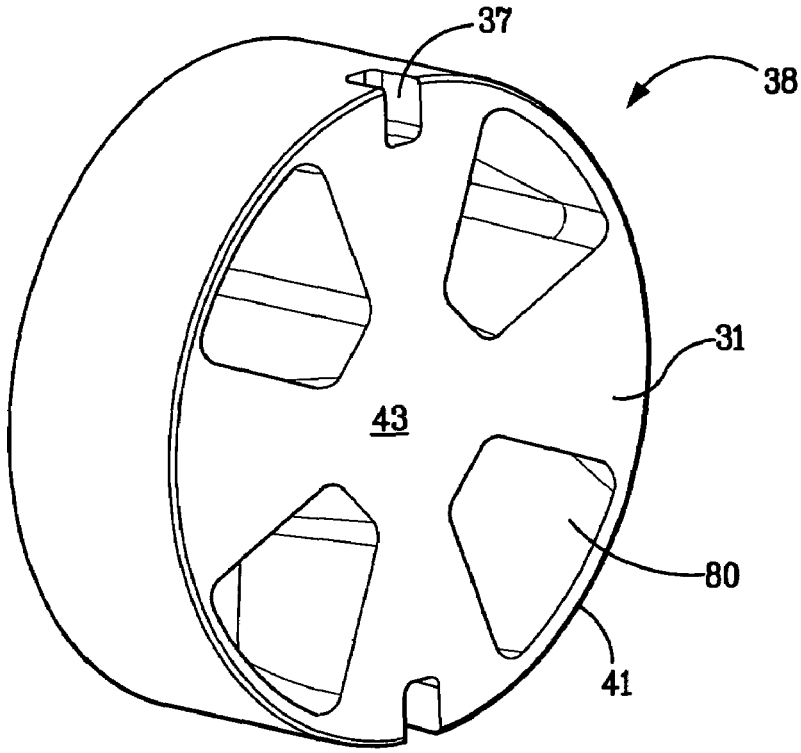
FIGS. 11 and 12 are isometric and end views, respectively, of the stator shown in FIG. 5.
Figure 12:
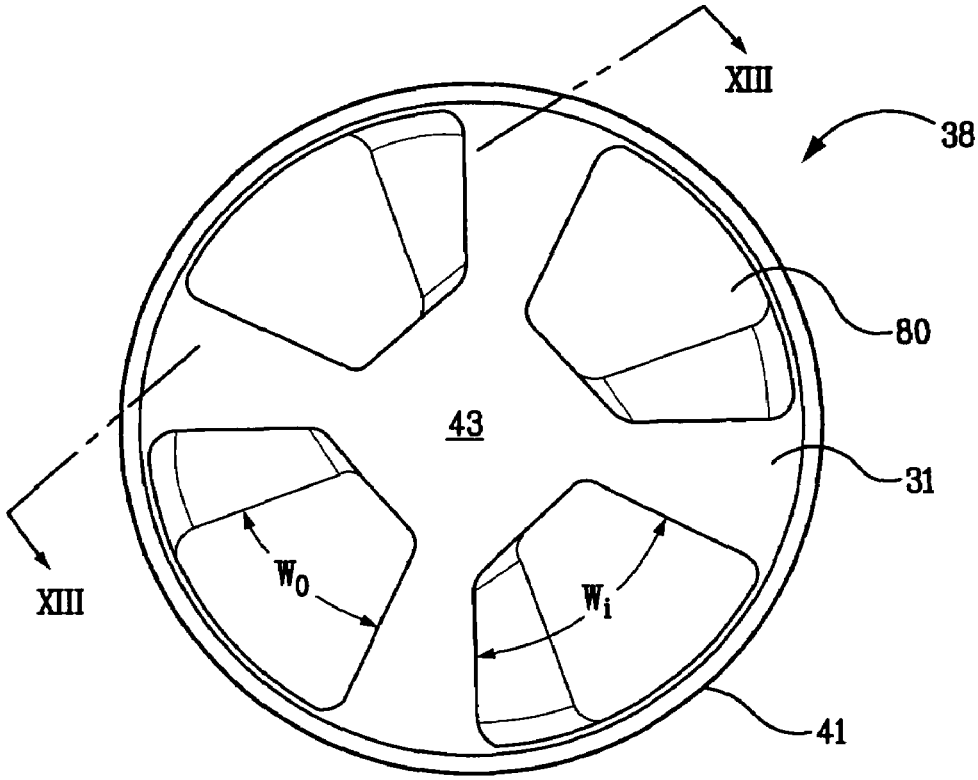
Figure 13A:
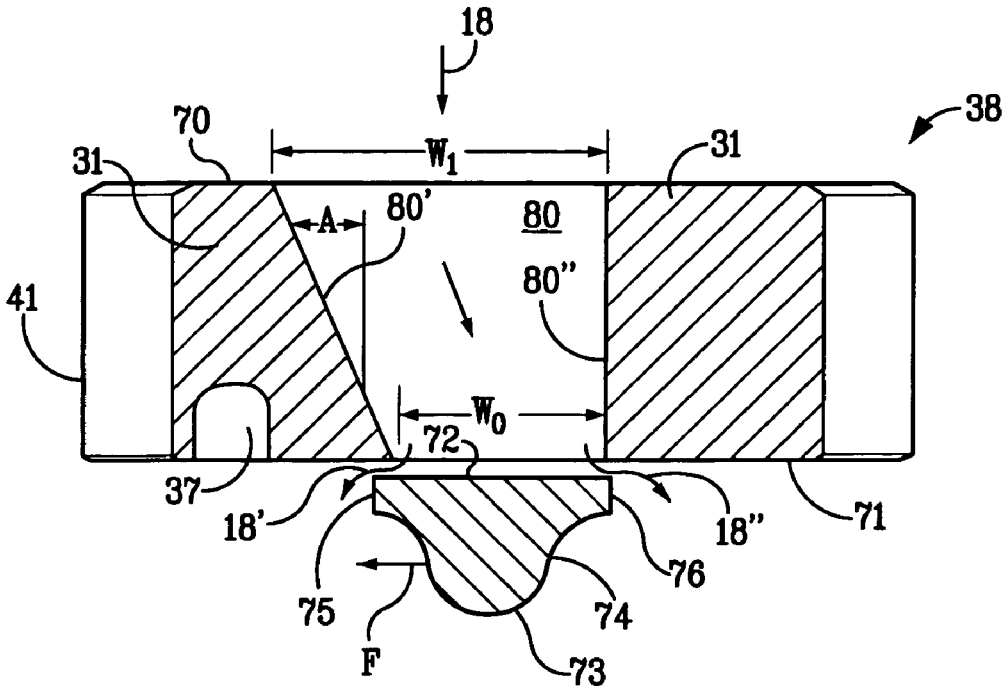
FIGS. 13(*a*) and (*b*) are transverse cross-sections of the stator shown in FIG. 5 taken through line XIII-XIII shown in FIG. 12 showing the downstream rotor blade in two circumferential orientations.
Figure 13B:
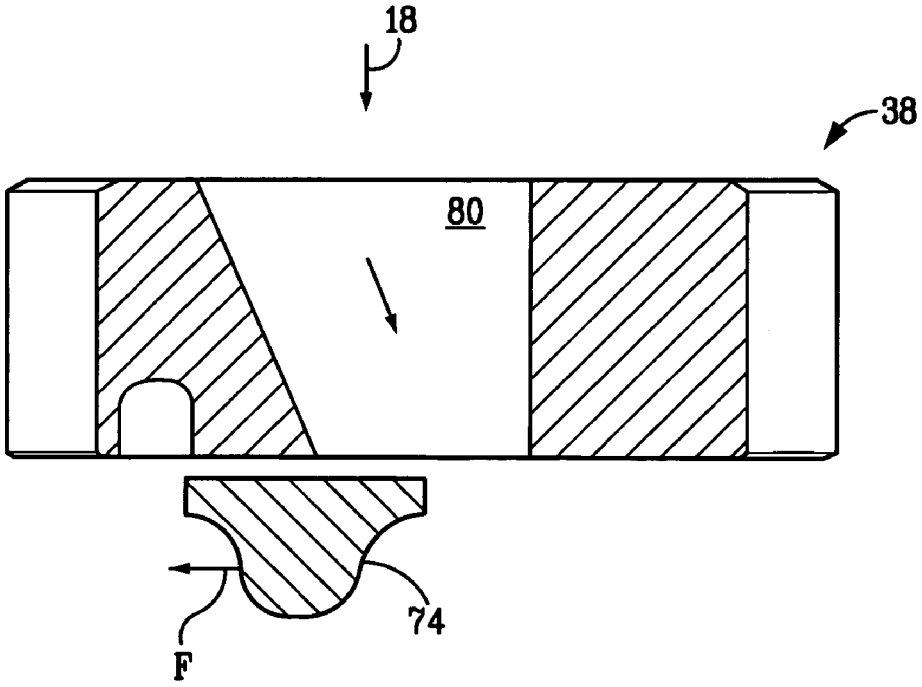

As shown in FIGS. 11 and 12, the stator 38, which is preferably made of tungsten carbide for wear resistance, is comprised of a hub 43, an outer rim 41, and vanes 31 extending therebetween that form axial passages 80 for the flow of drilling mud. Locating pins (not shown) extend into grooves 37 in the rim 41, shown in FIG. 11, to circumferentially orient the stator 38 with respect to the remainder of the pulser. According to one aspect of the invention, the stator 38 preferably swirls the drilling mud 18 as it flows through the passages 180. As shown in FIG. 13, this swirling is preferably accomplished by inclining one of the walls 80' of the passage 80 at an angle A to the axial direction. The angle A preferably increases as the passage 80 extends radially outward and is preferably in the range of approximately 10° to 15°. The other wall 80" of the passage 180 is oriented in a plane parallel to the central axis so that the circumferential width $W_i$ of the passage 80 at the inlet face 70 of the stator 38 is larger than the width $W_o$ at the outlet face 71. However, both walls of the passages could also be inclined if preferred.

Figure 14:
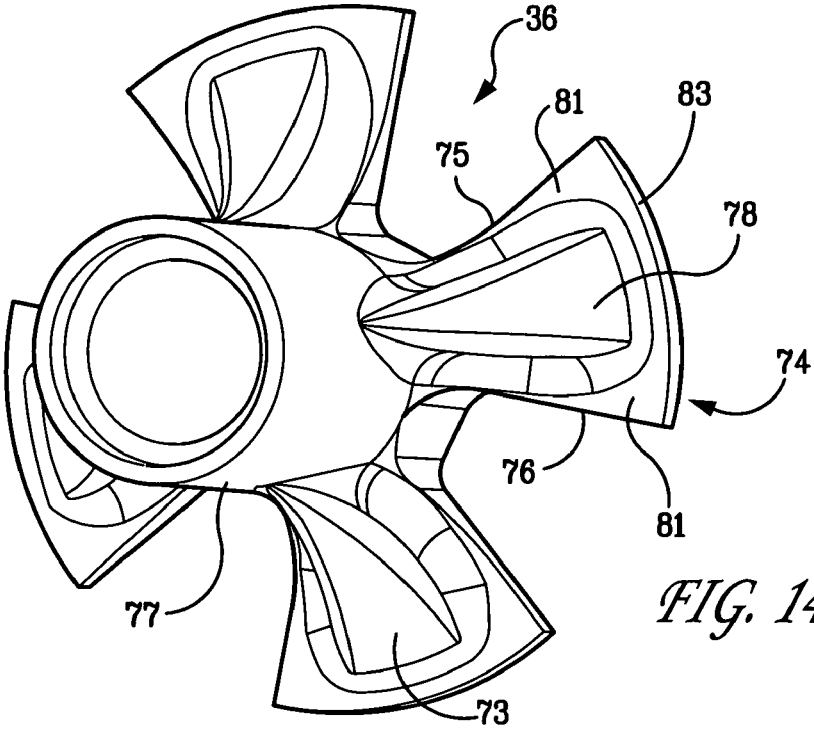
FIGS. 14 and 15 are isometric and elevation views, respectively, of the rotor shown in FIG. 5.
Figure 17A:
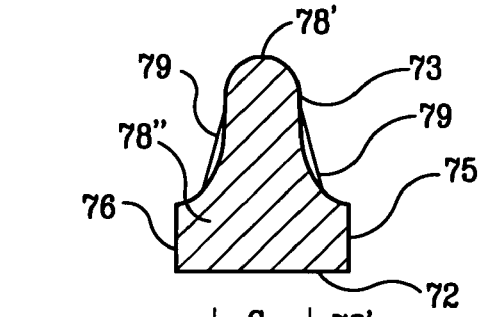
FIGS. 17(*a*) to (*d*) are a series of transverse cross-sections through one of the blades of the rotor shown in FIG. 5 taken along lines (a)-(a) through (d)-(d) shown in FIG. 16.
Figure 17B:
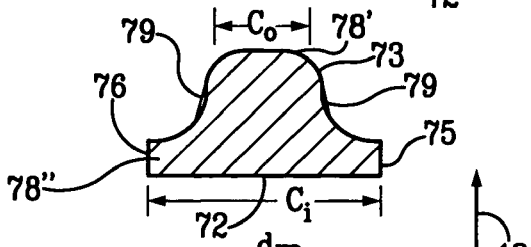
Figure 17C:
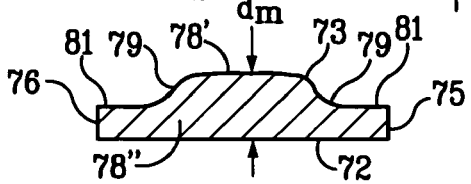
Figure 17D:
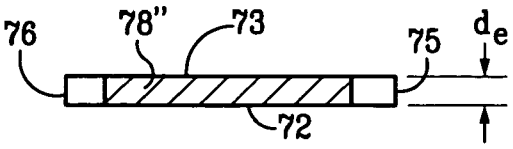
Figure 15:
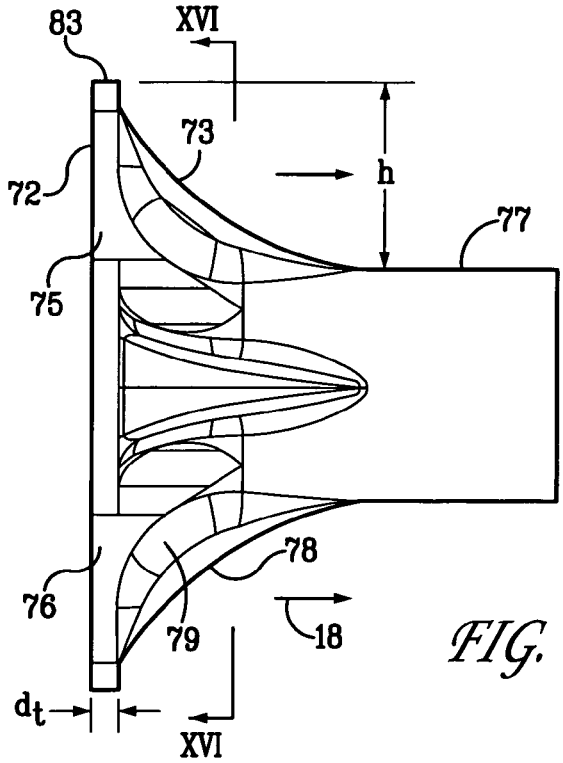
Figure 16:
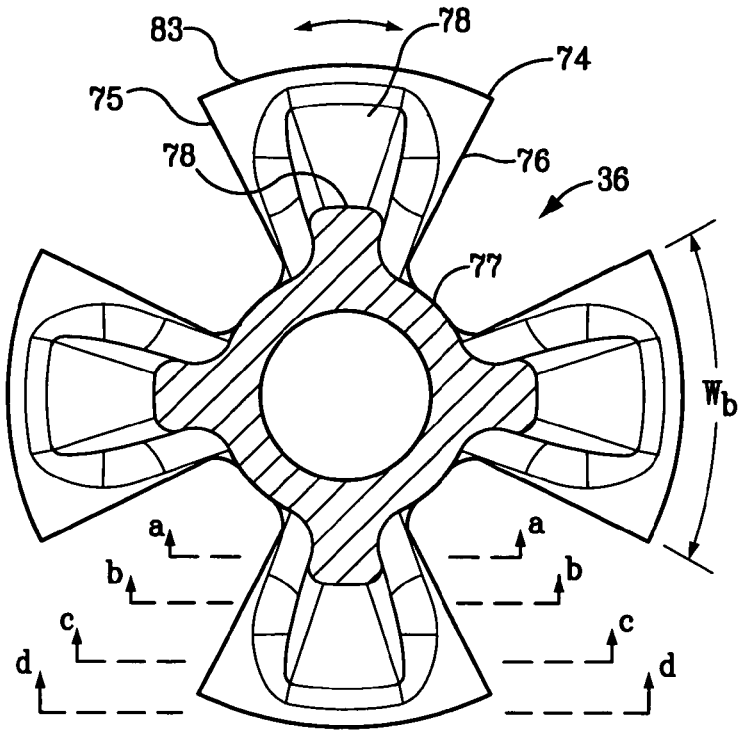
FIG. 16 is a transverse cross-section of the rotor shown in FIG. 5 taken along line XVI-XVI shown in FIG. 15.

As shown in FIGS. 14-16, the rotor 36 is comprised of a central hub 77 from which a plurality of blades 74 extend radially outward, the radial height of the blades being indicated by h in FIG. 15. As discussed further below, the blades 74 are capable of imparting a varying obstruction to the flow of drilling mud 18 depending on the circumferential orientation of the rotor 36 relative to the stator 38. Although four blades are shown in the figures, a greater or lesser number of blades could also be utilized. Each blade 74 has first and second lateral sides 75 and 76 that define the circumferential width $W_b$ of the blade. Preferably, the circumferential width $W_b$ of the blades 74 is slightly larger, preferably at least 1% larger, than the circumferential width $W_o$ at the stator outlet face 71 immediately upstream of the rotor 36. The surface 72, of the rotor 36 including the blades 74, preferably lies substantially in a plane so that it is substantially flat. In contrast to the prior art rotor shown in FIG. 1, according to one aspect of the invention, the rotor 36 is oriented so that the planar surface 72 forms the upstream surface of the rotor. However, provided that it forms an adequate obstruction to the flow of drilling mud for purposes of pulse generation, the shape of the upstream surface of the rotor blades 74 is not critical to the present invention and shapes other than flat surfaces can also be employed.

As shown in FIG. 16, the lateral sides 75 and 76 of the rotor blades 74 form an acute angle so that the blades become wider in the circumferential direction as they extend radially outward. Of more importance for present purposes, in longitudinal cross section, the blades 74 are shaped so as to become thinner in the axial direction as they extend radially outward, as shown in FIG. 15. This radial thinning is accomplished by shaping the profile of the blade downstream surface 73 so that the surface extends axially upstream as it extends radially outward (the direction of flow of the drilling mud 18 with respect to the rotor is indicated by the arrows in FIG. 15). Comparison of transverse cross-sections through the blade 74 at four radial locations, shown in FIGS. 17(*a*)-(*d*), shows that the maximum blade thickness in the axial direction $d_m$ (indicated in FIG. 17(*c*)) is greatest at the hub of the blade (FIG. 17(*a*)) and decreases to a minimum at the tip (FIG. 17(*d*)), with the decrease in thickness resulting from the downstream surface 73 being displaced axially forward as it extends radially upward. The thickness de adjacent the lateral sides 75 and 76 (indicated in FIG. 17(*d*)) similarly thins down as the blade 74 extends radially outward.

As shown in the transverse cross sections through the blade 74 shown in FIGS. 17(*a*)-(*c*), over a least a major portion—i.e., at least one half—of the radial height of the blade, and more preferably throughout the entirety of the radial height of the blade except the portion adjacent the radially outward tip 83 (shown in FIG. 17(*d*)), the downstream surface 73 is profiled so that it projects downstream as its extends circumferentially inward from the lateral sides 75 and 76 toward the center of the blade—that is, the blades are inwardly tapered in the downstream direction. Thus over this portion of the blade, its downstream surface 73 is not only radially tapered but is also circumferentially tapered so that the thickness is a maximum at the center of the blade, midway between the lateral sides 75 and 76, and becomes thinner as the surface extends circumferentially outward in both the clockwise and counterclockwise directions, reaching a minimum thickness $d_e$ adjacent the lateral sides. Thus, over a least a major portion of the radial height of the blade 74, and more preferably throughout the entirety of the radial height of the blade except the portion adjacent the radially outward tip 83, at a given transverse cross section, the thickness of the blade in the axial direction is tapered so as to become thicker as the surface 73 extends in the downstream direction. Further, over this portion of the blade, the circumferential width of the blade decreases as the blade extends in the axial direction, from $c_i$ at the blade upstream surface 72 to $c_o$ at the downstream most portion of the downstream surface 73, as shown in FIG. 17(*a*)-(*c*).

As shown best in FIGS. 14 and 17, except at the tip 83, in transverse cross-section, the shape of each blade 74 is formed by superimposing a relatively thickened central rib 78' onto a relatively thinner flat plate-like portion 78", with the plate-like portion 78" located upstream of the central rib 78'. The plate-like portion 78" forms the lateral sides 75 and 76 of the blade. The central rib 78' has tapered portions 79 on either side so as to blend into the surface 81 of the plate-like portion 78". Preferably, the central rib 78', and to a lesser extent the plate-like portion 78", are tapered as the blade extends radially outward so that the maximum thickness of the blade $d_m$ decreases as the blade extends radially outward, as discussed above.

Preferably, the thickness of the blade is tapered in the circumferential direction so that at a given transverse cross section, such as those shown in FIG. 17, the maximum thickness of the blade $d_m$ is at least twice the thickness $d_e$ adjacent the lateral sides 75 and 76 over at least a major portion of the radial height of the blade 74, and more preferably throughout the entirety of the radial height of the blade except the portion adjacent the radially outward tip 83. In the approximately outer two-thirds of the blade, the surfaces 81 adjacent the lateral sides 75 and 76 are substantially flat. However, of most importance is the fact that the thickness $d_e$ at the lateral sides 75 and 76 and the thickness $d_t$ at the radial tip 83 are relatively thin. Preferably the thickness adjacent the lateral sides 75 and 76 $d_e$ and the tip 83 $d_t$ should be not more than about ¼ inch (6 mm) thick and, more preferably, not more than about ⅛ inch (3 mm), over a major portion of the radial height of the blade. The thickness could be reduced essentially to zero so that the lateral sides and tip were formed by sharp edges.

By shaping the blade downstream surface 73 so that it tapers in both the radial and circumferential directions, having a maximum thickness in the center of the blade hub and becoming thinner as the blade extends both radially and circumferentially outward, so as to form a tapered central rib 78, sufficient mechanical strength is imparted to the blade 74 while minimizing the thickness of the blade at its edges, thereby improving the hydrodynamic performance of the blade, as discussed below. Preferably, the profiling of the downstream surface 73 is such that the taper in the thickness is achieved smoothly and gradually without abrupt steps in thickness, as shown in FIGS. 17(*a*)-(*c*).

Figure 18A:
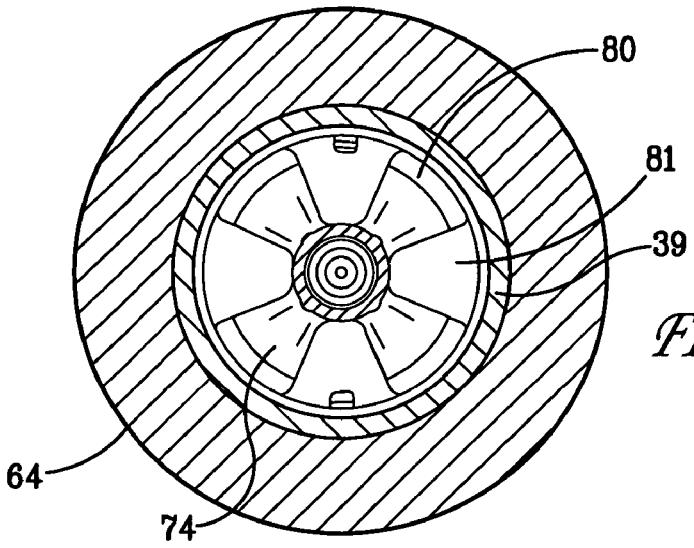
FIGS. 18(*a*), (*b*), and (*c*) are cross-sections of the pulser taken along line XVIII-XVIII shown in FIG. 5 with the rotor in three circumferential orientations—(a) maximum obstruction, (b) intermediate obstruction, and (c) minimum obstruction.
Figure 18B:
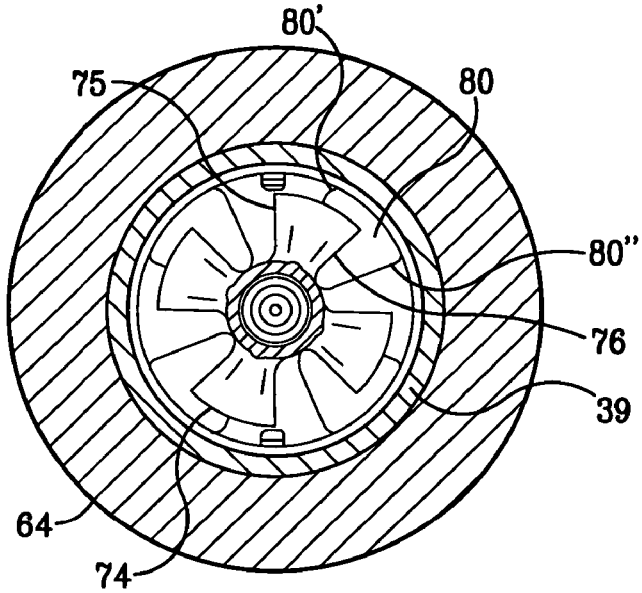
Figure 18C:
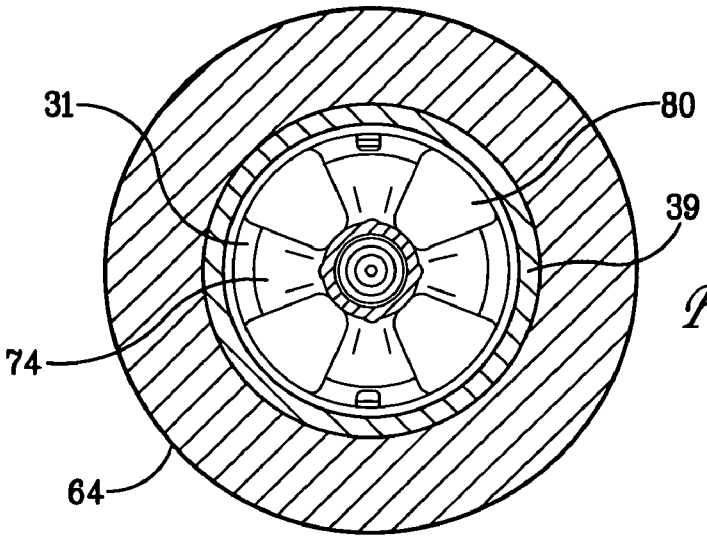

In operation, a pulse is created in the drilling mud 18 by rotating the rotor 36 into a first circumferential orientation that results in a reduced, or minimum, obstruction to the flow of drilling mud, such as shown in FIG. 18(*c*) in which the rotor blades 74 are axially aligned with the stator vanes 31, then rotating the rotor into a second circumferential orientation that results in an increased, or maximum, obstruction, such as shown in FIGS. 18(*a*) and 13(*a*) in which the rotor blades are axially aligned with the stator passages 80, then again rotating the rotor into an orientation in which the rotor blades are aligned with the stator vanes so as to result in the minimum obstruction. This last step is achieved by either reversing the prior rotation of the rotor or rotating it further in the same direction. This process is then repeated, as necessary, to create a series of pressure pulses encoded with the information to be transmitted to the surface, for example, using the methodology discussed in the aforementioned U.S. Pat. No. 6,714,138 (Turner et al.).

Although FIGS. 18(*a*) and (*c*) show the rotor 36 in orientations that result in the maximum and minimum obstructions achievable through rotation of the rotor, it should be understood that pulses can be created by rotating the rotor into and/or out of orientations intermediate of those shown in FIGS. 18(*a*) and (*c*), such as the intermediate circumferential orientation shown in FIGS. 18(*b*) and 13(*b*). Consequently, the pulse generating scheme could involve rotating the rotor 36 into and/or out of orientations resulting in obstructions less than the maximum and minimum obtainable. Note that, as shown in FIG. 18, preferably the radial height of the rotor blades 74 is less than that of the stator passages 38 so that the blades cannot completely obstruct the flow of drilling mud 18. In addition, the axial gap between the downstream face 71 of the stator 38 and the upstream surface 72 of the rotor 36 will ensure that the flow of drilling mud 18 will never be completely obstructed.

In one embodiment, pulses are created operating the motor 32 to place the rotor 36 into the circumferential orientation shown in FIG. 18(*c*) in which the rotor blades 74 are aligned with the stator vanes 31 so that the obstruction to the flow of drilling mud 18 is a minimum, then operating the motor to rotate the rotor clockwise (when looking against the direction of flow) about 45°, through the orientation shown in FIG. 18(*b*), thereby increasing the obstruction, and into the orientation shown in FIG. 18(*a*) in which the rotor blades are aligned with the stator passages 80 so that the obstruction to the flow reaches its maximum, and then reversing the operation of the motor to rotate the rotor in the counterclockwise direction 45° so as to return to the minimum obstruction orientation shown in FIG. 18(*c*). This motor driven oscillation between the minimum and maximum obstructions is repeated as necessary to transmit the encoded information. Mechanical stops 59, which engage a relief in the rotor shaft, limit the maximum rotation of the rotor to about 55° so that, although playing no role in the generation of pulses by the motor 32, these stops ensure that the rotation of the rotor when the pulser is not in operation is limited to approximately 5° beyond the minimum and maximum obstruction orientations.

Figure 1:
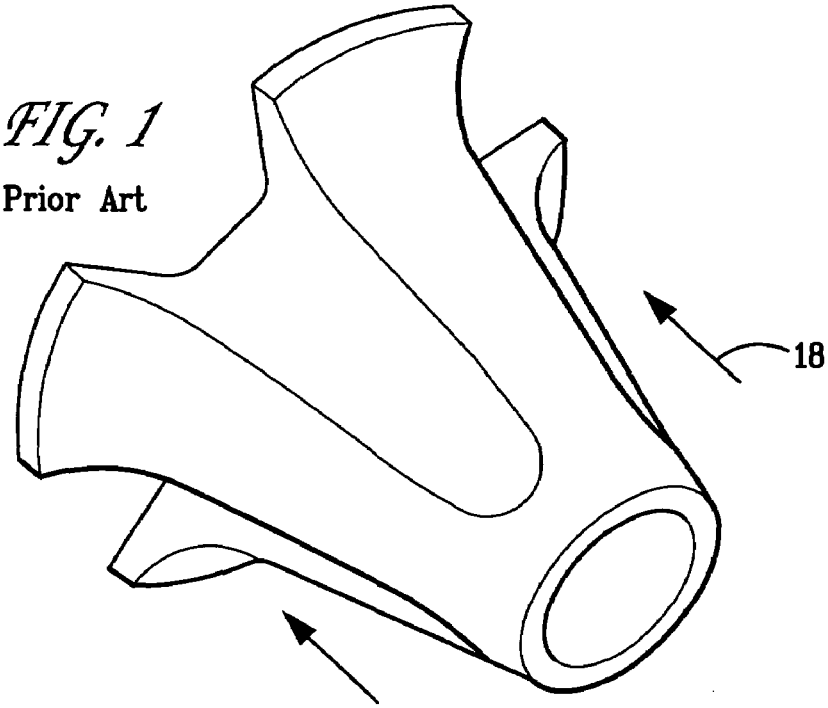
FIG. 1 Prior Art
FIG. 1 is an isometric view of a prior art rotor.

When using a prior art rotor, such as that shown in FIG. 1, the drilling mud 18 imposed a closing torque on the rotor tending to rotate it counterclockwise from the minimum flow orientation shown in FIG. 18(*c*) into the orientation of maximum obstruction shown in FIG. 18(*a*) when the motor 32 was not controlling the rotation of the rotor during pulse generation, as previously discussed. Surprisingly, it has been found that the design described above does not result in the creation of such flow induced closing torque. In fact, it has been found that, not only does the current invention eliminate the closing torque, it results in the creation of an opening torque, indicated by F in FIGS. 13(*a*) and (*b*), that tends to rotate the rotor blades 74 away from the orientation of maximum obstruction into an orientation of lesser obstruction. In one embodiment, the rotor 36 achieves a stable circumferential orientation—that is, one in which the flow does not impose a torque on the rotor in either direction that is sufficient to overcome its resistance to rotation, so that the rotor will stably remain at such an orientation—that is approximately half way between that shown in FIGS. 18(*b*) and 18(*c*)—that is, only about one-quarter obstructed.

The primary contributors to this hydrodynamic effect are believed to be (i) the locating of the rotor 36 immediately downstream of the stator 38, and (ii) the shaping of the rotor blade downstream surfaces 73 so that the blade thickness tapers as the blade extends outward in the circumferential direction from its center, thereby forming a relatively thin structure adjacent the lateral sides 75 and 76. Although not necessary to practice the current invention, in the optimal design, additional contributions to this effect are also believed to result from (i) the tapering of the blade as it extends outward in the radial direction, thereby forming relatively thin radial tips 83, (ii) the swirling of the drilling mud 18 by the stator passages 80 as shown in FIG. 13, and (iii) the control of leakage around the lateral sides of the rotor blades, as discussed below.

With respect to the swirling of the drilling mud 18, contrary to what might be expected, it has been found that swirling the drilling mud in the clockwise direction prior to its introduction into the rotor 36 increases the opening torque F on the rotor blades in the counterclockwise direction, thereby tending to rotate the rotor away from an orientation of maximum obstruction and toward an orientation of minimum obstruction, as indicated in FIG. 13(*b*).

With respect to the control of side leakage, it has been found that a benefit can be obtained by controlling the leakage of drilling mud passed the rotor blades when the rotor is in the orientation of maximum obstruction so that the leakage is less around one lateral side—the side facing the direction in which the rotor can rotate into an orientation of lesser obstruction—than the other lateral side. Preferably, the mechanical stops 59 are located such that the rotor will never rotate in the clockwise direction (i.e., to the right in FIG. 13) beyond the maximum obstruction orientation into an orientation in which the leakage of drilling mud 18' around the counterclockwise most lateral side 75 of the rotor blade 74 is less than that around the clockwise most lateral side 76, as shown in FIG. 13(*a*). This can preferably be achieved by sizing of the width $W_b$ of the rotor blades 74 in the circumferential direction so as to be slightly larger than the width $W_o$ of the stator passages in the outlet face 70 of the stator 38, so that when the rotor is against the stop near the maximum obstruction orientation, the counterclockwise most lateral side 75 of the blade 74 extends beyond the counterclockwise most wall 80' of the passage 80 further than the clockwise most lateral side 76 of blade extends beyond the clockwise most wall 80", as shown in FIG. 13(*a*). The additional overlap of the blade 74 with respect to the stator vane 31 at the counterclockwise most lateral side 75 ensures that the leakage 18' passed the counterclockwise most lateral side 75 is less than the leakage 18" passed the clockwise most lateral side 76, which aids in the creation of the flow induced opening torque that rotates the rotor 36 counterclockwise from the maximum obstruction orientation shown in FIGS. 13(*a*) and 18(*a*) toward the orientations shown in FIGS. 13(*b*) and 18(*b*) and (*c*).

Although, ideally, the flow induced opening torque created by the current invention is such that the minimum obstruction orientation shown in FIG. 18(*c*) is a stable orientation, this may not always be achieved. For example, the stable orientation may be the one-quarter open orientation, as previously discussed. Consequently, although not necessary to practice the invention, according to another aspect of the invention, in addition to the creation of the flow induced opening torque, the rotor 36 may also be mechanically biased toward the minimum obstruction orientation.

Figure 19:
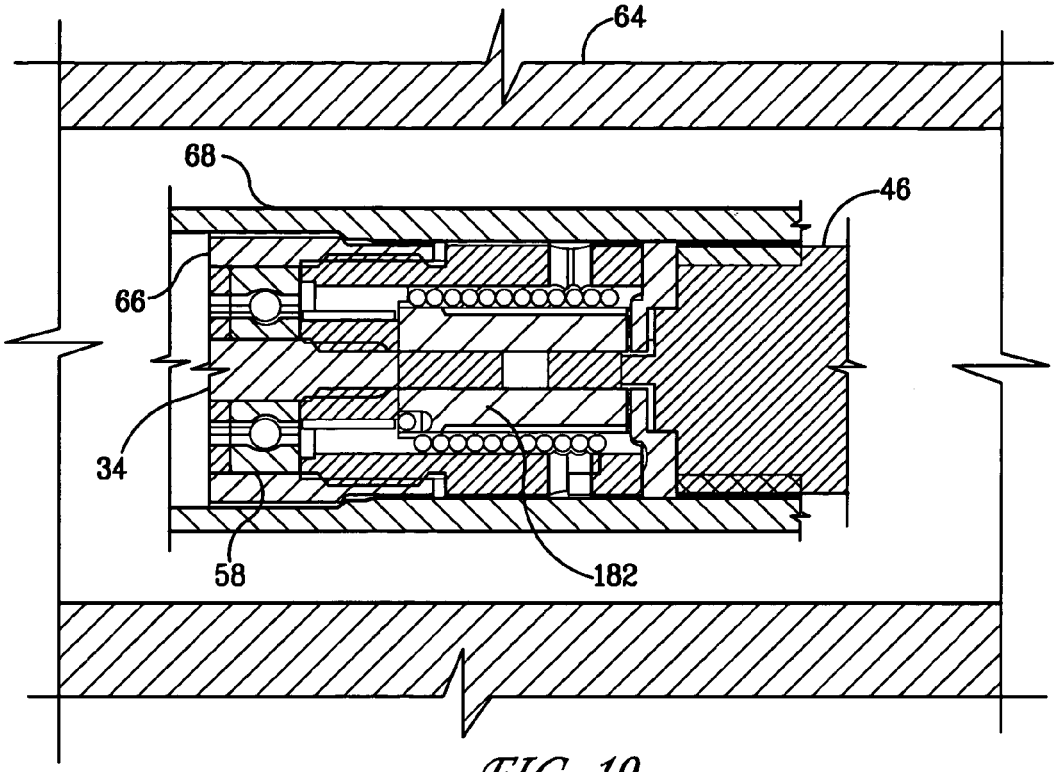
FIG. 19 is a detailed view of the portion of FIG. 5 containing the torsion spring according to the current invention.
Figure 20:
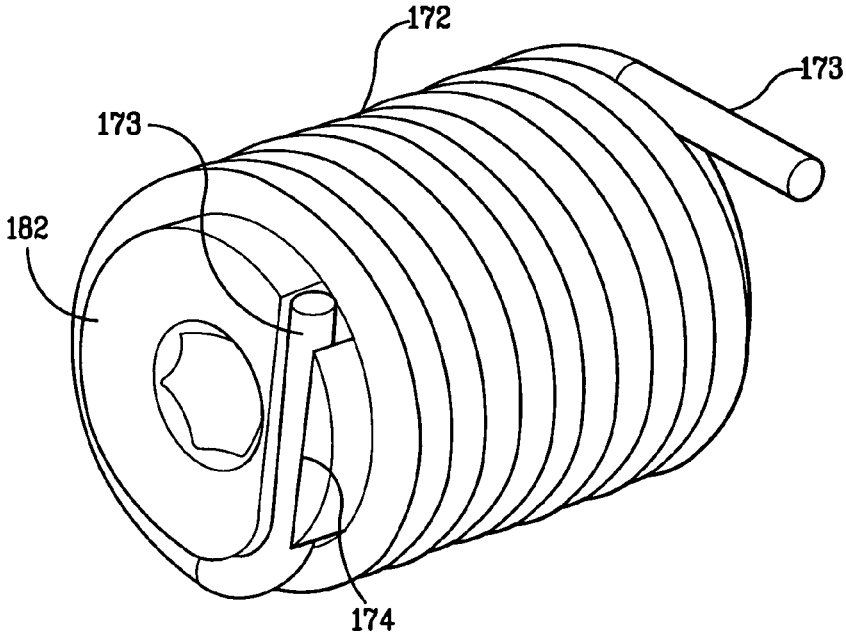
FIG. 20 is an isometric view of the torsion spring shown in FIG. 5 installed on the coupling between the rotor shaft and the reduction gear.

Preferably, such mechanical bias is obtained by incorporating a torsion spring 172 between the shafting and the pulser housing 66, as shown in FIGS. 19 and 20. Preferably, the torsion spring 172 is mounted on the coupling 182 between the rotor shaft 34 and the reduction gear 46. One end 173 of the spring 172 is held in place by a groove 174 in the coupling 182 so as to be coupled to the rotor 36, while the other end 175 of the spring is held in place by a recess in the housing 66. Rotation of the coupling 182 relative to the housing 66 causes the spring to impart a resisting torque to the coupling.

In the embodiment of the invention previously discussed, the torsion spring 172 is mounted so that it imparts a torque that combines with the flow induced opening torque when the rotor is in the maximum obstruction orientation to drive the rotor toward the minimum obstruction orientation. Further, the torsion spring 172 continues to impart a mechanical opening torque after the flow induced opening torque becomes insufficient to further rotate the rotor passed the one-quarter closed orientation shown in FIGS. 13(*b*) and 18(*b*) that drives the rotor 36 into the minimum obstruction orientation, shown in FIG. 18(*c*). The torsion spring 172 imparts an increasing torque as the rotor rotates clockwise away from the minimum obstruction orientation that urges it to return to the minimum obstruction orientation. Thus, although the flow induced opening torque would otherwise cause the stable orientation of the rotor to be about halfway between FIGS. 18(*b*) and (*c*)—about one-quarter open—as previously discussed, the addition of the mechanical torque supplied by the torsion spring 172 results in the stable orientation being the minimum obstruction orientation shown in FIG. 18(*c*).

If the pulser were constructed so that the minimum orientation was otherwise a stable orientation—that is, the flow induced torque alone was sufficient to maintain the rotor in the minimum obstruction orientation—the torsion spring 172 could be installed so that it imparted no torque when the rotor was in the minimum obstruction orientation and a torque tending to return the rotor to the minimum obstruction orientation whenever the rotor rotated away from that orientation.

Although the mechanical biasing of the rotor is preferably additive to the flow induced opening torque, the invention could also be practiced by employing mechanical biasing alone, such as by the torsion spring 172, while using a rotor having conventional hydrodynamic performance in which the flow induced torque tended to rotate the rotor into the maximum obstruction orientation.

Although the current invention has been illustrated by reference to certain specific embodiments, those skilled in the art, armed with the foregoing disclosure, will appreciate that many variations could be employed. For example, although the invention has been discussed in detail with reference to an oscillating type rotary pulser, the invention could also be utilized in a pulser that generated pulses by rotating a rotor in only one direction. Thus, for example, reference to a rotor "circumferential orientation" that results in a minimum obstruction to the flow of drilling fluid applies to any orientation in which the rotor blades 36 are axially aligned with the stator vanes so that, for example, in the structure shown in FIG. 18 in which the stator vanes 31 are spaced at 90° intervals, both the rotor orientation shown in FIG. 18(*c*) as well as an orientation in which the rotor was rotated 90°, 180°, and 270° therefrom would all be considered as a single, or first, circumferential orientation since in each of these cases the rotor blades would be axially aligned with the stator vanes. Similarly, both the rotor orientation shown in FIG. 18(*a*) as well as an orientation that was 90°, 180°, and 270° therefrom would all be considered as a single, or second, circumferential orientation since in each of these cases the rotor blades would be axially aligned with the stator passages 80.

Therefore, it should be appreciated that the current invention may be embodied in other specific forms without departing from the spirit or essential attributes thereof and, accordingly, reference should be made to the appended claims, rather than to the foregoing specification, as indicating the scope of the invention.

What is claimed is:

1. A rotary pulser for transmitting information from a portion of a drill string operating at a down hole location in a well bore, said drill string having a passage through which a drilling fluid flows, comprising:

a) a housing adapted to be mounted in said drill string;

b) a stator supported in said housing and having at least one approximately axially extending passage formed therein through which at least a portion of said drilling fluid flows;

c) a rotor supported in said housing adjacent said stator and downstream therefrom, said rotor having at least one blade extending radially outward so as to define a radial height thereof, said rotor blade having upstream and downstream surfaces and first and second sides each extending between said upstream and downstream surfaces, said rotor being rotatable into at least first and second circumferential orientations, said blade imparting a varying degree of obstruction to said flow of drilling fluid flowing through said stator passage depending on the circumferential orientation of said rotor, said first rotor circumferential orientation providing a greater obstruction to said flow of drilling fluid than that of said second rotor circumferential orientation, whereby rotation of said rotor generates a series of pulses encoded with said information to be transmitted; and d) a motor coupled to said rotor for imparting rotation to said rotor, whereby operation of said motor generates said series of encoded pulses;

e) wherein said first and second sides of said rotor blade are inwardly tapered in transverse cross-section as said first and second sides extend from said upstream surface to said downstream surface of said rotor blade so that said rotor blade imparts a torque to said rotor when said motor is not operating so as to reduce the obstruction imparted by said blade to said flow of drilling fluid when said motor is not operating.

2. The rotary pulser according to claim 1, further comprising a spring mounted within said housing for further reducing the obstruction imparted by said blade to said flow of drilling fluid when said motor is not operating.

3. The rotary pulser according to claim 2, wherein said spring comprises a torsion spring having a first end coupled to said housing and a second end coupled to said rotor.

4. The rotary pulser according to claim 3, wherein said torsion spring is mounted so as to impose a torque on said shaft when said rotor is rotated into said first circumferential orientation that drives said rotor toward said second circumferential orientation.

5. The rotary pulser according to claim 1, wherein at least a major portion of said radial height said rotor blade has a shape in transverse cross-section formed by superimposing a thickened central rib onto a thinner plate-like portion.

6. The rotary pulser according to claim 5, wherein said plate-like portion forms first and second lateral sides of said blade and a substantially flat surface therebetween.

7. The rotary pulser according to claim 6, wherein said plate-like portion forms first and second lateral sides of said blade, and wherein said thickness of said plate-like portion proximate said first and second lateral sides is no more than approximately ¼ inch (6 mm) over at least a major portion of said radial height of said blade.

8. The rotary pulser according to claim 5, wherein the thickness of said central rib is tapered so as to be thinner as said blade extends radially outward.

9. The rotary pulser according to claim 1, wherein said rotor blade downstream surface and first and second sides extend in both the radial and circumferential directions, and wherein said rotor blade downstream surface and first and second sides are profiled over at least a major portion of said radial height of said blade so that in transverse cross section a thickness of said rotor blade increases as said rotor blade downstream surface and first and second sides extend downstream.

10. The rotary pulser according to claim 9, wherein said thickness of said rotor blade is at a minimum proximate said first and second sides.

11. The rotary pulser according to claim 9, wherein said thickness of said blade proximate said first and second sides is no more than approximately ¼ inch (6 mm) over at least a major portion of said radial height of said blade.

12. The rotary pulser according to claim 11, wherein said rotor blade has a radially outward tip, and wherein said thickness of said blade proximate said tip is no more than approximately ¼ inch (6 mm).

13. The rotary pulser according to claim 9, wherein said downstream surface and first and second sides of said rotor blade are profiled over at least a major portion of said radial height of said blade so that in transverse cross section said thickness of said rotor blade is at a maximum at an approximate circumferential mid-point of said rotor blade.

14. The rotary pulser according to claim 9, wherein said rotor blade downstream surface is profiled over at least a major portion of said radial height of said blade so that in transverse cross-section said thickness of said rotor blade generally decreases as said surface extends circumferentially toward said first and second sides in the both the clockwise and counterclockwise directions over at least a portion of a circumferential width of said blade.

15. The rotary pulser according to claim 9, wherein said rotor blade downstream surface and first and second sides are profiled so that said thickness of said rotor blade generally decreases as said rotor blade downstream surface and first and second sides extend radially outward over at least a major portion of said radial height of said blade.

16. The rotary pulser according to claim 15, wherein said rotor blade downstream surface and first and second sides are profiled so that said decrease in thickness is obtained by displacing said downstream surface and first and second sides in the upstream direction as said blade extends radially outward.

17. The rotary pulser according to claim 9, wherein said upstream surface of said rotor blade forms a substantially planar surface.

18. The rotary pulser according to claim 9, wherein said stator passage and said rotor blade each have a width in the circumferential direction, said circumferential width of said rotor blade being greater than said width of said stator passage.

19. The rotary pulser according to claim 9, wherein said stator passage comprises means for swirling said drilling fluid in a circumferential direction.

20. The rotary pulser according to claim 1, wherein said motor rotates said rotor in an oscillatory fashion in both clockwise and counterclockwise directions to generate said pulses.

21. The rotary pulser according to claim 1, wherein said motor rotates said rotor in a single direction to generate said pulses.

22. The rotary pulser according to claim 1, wherein said stator comprises at least one vane adjacent said passage, and wherein said rotor blade is aligned with said vane when said rotor is in said second circumferential orientation.

23. The rotary pulser according to claim 1, wherein said rotor blade is aligned with said passage when said rotor is in said first circumferential orientation.

24. The rotary pulser according to claim 23, wherein said drilling fluid flowing through said passage leaks past said first and second sides when said rotor is in said first circumferential orientation, and wherein said torque imparting means causes said leakage past said first side to be greater than said leakage past said second side.

25. The rotary pulser according to claim 1, wherein said stator comprises at least one vane adjacent said passage, and wherein said rotor blade is partially aligned with both said vane and said passage when said rotor is in said first circumferential orientation.

26. The rotary pulser according to claim 1, wherein said stator comprises at least one vane adjacent said passage, and wherein said rotor blade is partially aligned with both said vane and said passage when said rotor is in said second circumferential orientation.

27. A rotary pulser for transmitting information from a portion of a drill string operating at a down hole location in a well bore, said drill string having a passage through which a drilling fluid flows, comprising:

a) a housing adapted to be mounted in said drill string;

b) a stator supported in said housing and having at least one approximately axially extending passage formed therein through which at least a portion of said drilling fluid flows;

c) a rotor supported in said housing and located downstream of said stator, (i) said rotor having at least one blade extending radially outward so as to define a radial height thereof, said blade imparting a varying degree of obstruction to said flow of drilling fluid flowing through said stator passage depending on the circumferential orientation of said rotor, (ii) said rotor being rotatable into at least first and second circumferential orientations, said first rotor circumferential orientation providing a greater obstruction to said flow of drilling fluid than that of said second rotor circumferential orientation, whereby rotation of said rotor generates a series of pulses encoded with said information to be transmitted, (iii) said rotor blade having upstream and downstream surfaces and first and second sides extending between said upstream and downstream surface, in transverse cross-section said first and second sides of said rotor being inwardly tapered as they extend in the direction of said flow of drilling fluid over at least a major portion of said radial height of said blade.

28. The rotary pulser according to claim 27, wherein at least a major portion of said radial height said rotor blade has a shape in transverse cross-section formed by superimposing a thickened central rib onto a thinner plate-like portion.

29. The rotary pulser according to claim 28, wherein said plate-like portion forms first and second lateral sides of said blade and a substantially flat surface therebetween.

30. The rotary pulser according to claim 28, wherein said plate-like portion forms said first and second sides of said blade, and wherein said thickness of said plate-like portion proximate said first and second sides is no more than approximately ¼ inch (6 mm) over at least a major portion of said radial height of said blade.

31. The rotary pulser according to claim 28, wherein the thickness of said central rib is tapered so as to become thinner as said blade extends radially outward.

32. The rotary pulser according to claim 28, wherein said rotor blade first and second lateral sides define a circumferential width of said rotor blade therebetween, and wherein said downstream surface of said rotor blade is profiled over at least a major portion of said radial height of said blade so that in transverse cross section said thickness of said rotor blade is at a minimum proximate said first and second sides.

33. The rotary pulser according to claim 27, wherein said thickness of said blade proximate said first and second sides is no more than approximately ¼ inch (6 mm) over at least a major portion of said radial height of said blade.

34. The rotary pulser according to claim 33, wherein said rotor blade has a radially outward tip, and wherein said thickness of said blade proximate said tip is no more than approximately ¼ inch (6 mm).

35. The rotary pulser according to claim 27, wherein said downstream surface and first and second sides of said rotor blade are profiled over at least a major portion of said radial height of said blade so that in transverse cross section said thickness of said rotor blade is at a maximum approximately midway between said first and second sides.

36. The rotary pulser according to claim 27, wherein said rotor blade first and second lateral sides define the circumferential width of said rotor blade therebetween, wherein said rotor blade downstream surface and first and second sides are profiled over at least a major portion of said radial height of said blade so that in transverse cross-section said thickness of said rotor blade generally decreases as said surface extends circumferentially in the both the clockwise and counterclockwise directions over at least a portion of the circumferential width of said blade.

37. The rotary pulser according to claim 27, wherein said rotor blade downstream surface and first and second sides are profiled so that said decrease in thickness as said blade extends radially outward is obtained by displacing said downstream surface and first and second sides in the upstream direction as said blade extends radially outward.

38. The rotary pulser according to claim 27, wherein said upstream surface of said rotor blade forms a substantially planar surface.

39. The rotary pulser according to claim 27, wherein said stator passage and said rotor blade each have a width in the circumferential direction, said circumferential width of said rotor blade being greater than said width of said stator passage.

40. The rotary pulser according to claim 27, wherein said stator passage comprises means for swirling said drilling fluid in a circumferential direction.

41. The rotary pulser according to claim 27, wherein said motor rotates said rotor in an oscillatory fashion in both clockwise and counterclockwise directions to generate said pulses.

42. The rotary pulser according to claim 27, wherein said motor rotates said rotor in a single direction to generate said pulses.

43. The rotary pulser according to claim 27, wherein said stator comprises at least one vane adjacent said passage, and wherein said rotor blade is aligned with said vane when said rotor is in said second circumferential orientation.

44. The rotary pulser according to claim 27, wherein said rotor blade is aligned with said passage when said rotor is in said first circumferential orientation.

45. The rotary pulser according to claim 44, wherein said drilling fluid flowing through said passage leaks passed said first and second sides of said rotor blade when said rotor is in said first circumferential orientation, and wherein said leakage past said first lateral side is greater than said leakage past said second lateral side.

46. The rotary pulser according to claim 27,wherein said stator comprises at least one vane adjacent said passage, and wherein said rotor blade is aligned between said vane and said passage when said rotor is in said first circumferential orientation.

47. The rotary pulser according to claim 27, wherein said stator comprises at least one vane adjacent said passage, and wherein said rotor blade is aligned between said vane and said passage when said rotor is in said second circumferential orientation.

48. The rotary pulser according to claim 27, wherein said inward tapering of said first and second sides of said rotor as they extend in the direction of said flow of drilling fluid imparts a torque to said rotor when said motor is not operating so as to reduce the obstruction imparted by said blade to said flow of drilling fluid when said motor is not operating.

* * * * *

UNITED STATES PATENT AND TRADEMARK OFFICE

CERTIFICATE OF CORRECTION

PATENT NO. : 7,327,634 B2
APPLICATION NO. : 10/888312
DATED : February 5, 2008
INVENTOR(S) : Carl A. Perry et al.

It is certified that error appears in the above-identified patent and that said Letters Patent is hereby corrected as shown below:

Column 6,
Line 60, delete "oil-filed" and insert -- oil-filled --.

Column 8,
Line 28, delete "de" and insert -- $d_e$ --.
Line 32, delete "over a least" and insert -- over at least --.
Line 48, delete "over a least" and insert -- over at least --.

Column 15,
Line 61, delete "claim 28," and insert -- claim 27, --.
Line 62, after "second" delete "lateral".

Signed and Sealed this

Twenty-third Day of March, 2010

David J. Kappos

David J. Kappos
*Director of the United States Patent and Trademark Office*